US006472855B2

(12) United States Patent
Ball

(10) Patent No.: US 6,472,855 B2
(45) Date of Patent: Oct. 29, 2002

(54) VOLTAGE REGULATOR CIRCUIT WITH TRANSIENT GENERATOR TO RESPOND TO LOAD CURRENT CHANGES AND METHOD THEREFOR

(75) Inventor: Alan Ball, Gilbert, AZ (US)

(73) Assignee: Semiconductor Components Industries LLC, Phoenix, AZ (US)

( * ) Notice: Subject to any disclaimer, the term of this patent is extended or adjusted under 35 U.S.C. 154(b) by 0 days.

(21) Appl. No.: 09/758,661

(22) Filed: Jan. 12, 2001

(65) Prior Publication Data

US 2002/0093319 A1 Jul. 18, 2002

(51) Int. Cl.[7] ..... G05F 1/40
(52) U.S. Cl. ..... 323/282
(58) Field of Search ..... 323/282, 283, 323/284, 285, 351

(56) References Cited

U.S. PATENT DOCUMENTS 4,240,009 A * 12/1980 Paul ..... 315/224
4,245,286 A * 1/1981 Paulkovich et al. ..... 363/21
5,684,686 A * 11/1997 Reddy ..... 363/97

* cited by examiner

*Primary Examiner*—Adolf Deneke Berhane
(74) *Attorney, Agent, or Firm*—James J. Stipanuk

(57) ABSTRACT

A regulator circuit (10) includes an amplifier (61) having an input for sensing an output signal ($V_S$, $I_{LOAD}$) of the regulator circuit and an output (13) for producing a transient signal ($I_{TR1}$, $I_{TR2}$) in response to a change in the output signal. A feedback path (62, 67, 70) is coupled between the output and the input of the amplifier to set a gain of the amplifier to a first value when the output signal is constant and to a second value when the output signal changes. The feedback path includes a level shift circuit (62, 65) having an input (81) that receives the output signal and an output (83) that produces a level shifted signal for biasing the output of the amplifier to a predetermined level.

26 Claims, 3 Drawing Sheets

VOLTAGE REGULATOR CIRCUIT WITH TRANSIENT GENERATOR TO RESPOND TO LOAD CURRENT CHANGES AND METHOD THEREFOR

FIELD OF THE INVENTION

The present invention relates in general to semiconductor devices and, more particularly, to low voltage integrated voltage regulators for supplying high transient output currents.

BACKGROUND OF THE INVENTION

Personal computers currently are using microprocessors that operate with low power supply voltages while generating high transient switching currents. For example, typical microprocessors are specified to operate with supply voltages as low as 1.5 volts and narrow operating ranges while producing transient currents of at least thirty amperes.

The supply voltages often are generated by power supplies configured as voltage converters that include pulse width modulated switching regulators to conserve power. A typical switching regulator switches current through a coil to store energy on one portion of a cycle and then transfer the energy to a large output capacitor on another portion of the cycle to develop the supply voltage. However, switching regulators suffer from a low bandwidth, and consequently are unable to maintain the supply voltage within the specified range during a large load current transient. A high performance switching regulator has a bandwidth of about one hundred kilohertz, whereas at least one megahertz is needed for adequate regulation during a load current transient.

Power supplies can increase bandwidth by using Page 2 multiple switching regulators with parallel outputs and operating on staggered phases. However, multiple switching regulators do not improve the transient response enough to meet the requirements of current and future computer systems. Moreover, multiple switching regulators add substantially to the cost of the power supplies and the area occupied on a circuit board.

Hence, there is a need for a low voltage regulator that has a high bandwidth in order to maintain regulation of an output voltage during a large current transient.

DETAILED DESCRIPTION OF THE DRAWINGS

In the figures, elements having the same reference numbers have similar functionality.

Figure 1:
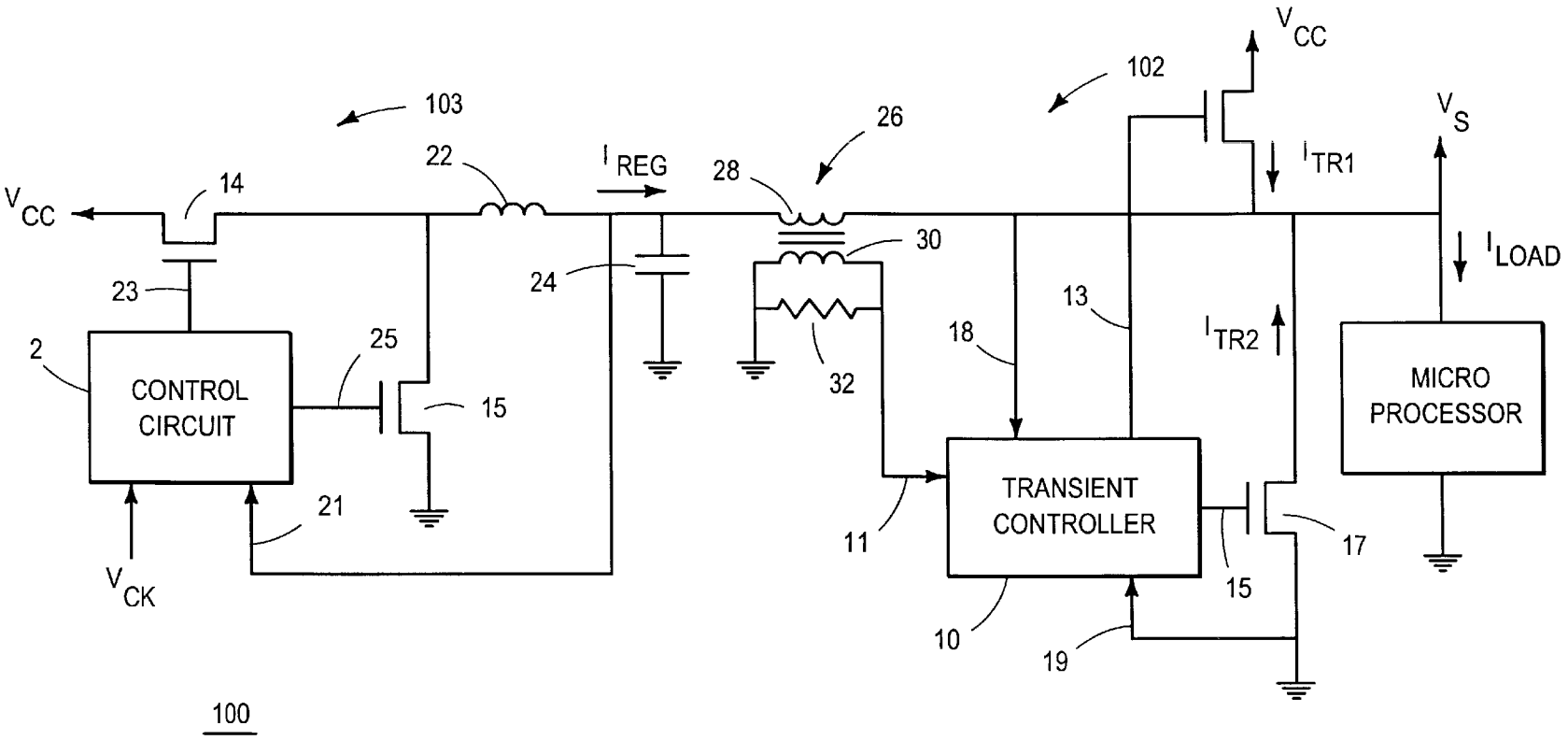
FIG. 1 is a schematic diagram of a computing circuit including a power supply.

FIG. 1 shows a schematic diagram of a computing circuit 100 including a power supply 101 that provides a supply voltage $V_S$ at an output 36 to a microprocessor 50 drawing a load current $I_{LOAD}$. Power supply 101 includes a transient generator 102 and a switching regulator 103. Switching regulator 103 provides a direct current (DC) or low frequency component $I_{REG}$ of $I_{LOAD}$ while transient generator 102 produces high frequency or transient components $I_{TR1}$ and $I_{TR2}$ as described below. Power supply 101 operates from a supply voltage $V_{CC}$5.0 =volts.

Microprocessor 50 is specified to operate with a 1.5 volt supply having a range of plus or minus fifty millivolts. Microprocessor 50 includes internal transistors that switch in order to execute programs and transfer data. The switching generates current transients which can aggregate to produce transient currents of more than thirty amperes with component frequencies of at least 1.2 megahertz. Reliable operation of microprocessor 50 requires that power supply 101 maintain supply voltage $V_S$ within the specified range even during a large load current transient.

Switching regulator 103 includes a control circuit 12, transistors 14–15 operating as a power stage, a coil 22 and a capacitor 24. In an alternate embodiment, power supply 101 includes a plurality of power stages connected in parallel and each driving a coil. Control circuit 12 comprises a pulse width modulated DC to DC converter for producing supply voltage $V_{REG}$=1.5 volts at a node 34 as a component of supply voltage $V_S$. Timing is set by a clock signal $V_{CK}$ operating at a frequency of four hundred kilohertz. Control circuit 12 includes a pulse width modulator configured to produce pulses at a nodes 23 and 25 for switching transistors 14 and 15, respectively. A sense input 21 is coupled to node 34 to monitor the amplitude of $V_{REG}$ for adjusting pulse widths to maintain $V_{REG}$ at a constant potential.

The operation of switching regulator 103 proceeds as follows. A cycle is initiated by a pulse of clock signal $V_{CK}$ which activates a comparator in control circuit 12 that compares supply voltage $V_{REG}$ with an internal reference to set the width of a pulse on node 23. The pulse turns on transistor 14 to route a charging current through coil 22. At the end of the pulse, transistor 14 turns off and transistor 15 turns on to transfer the charging current to capacitor 24 to complete the cycle. The pulse width is updated on each cycle in accordance with the magnitude of $I_{LOAD}$ to maintain $V_{REG}$ at the desired level. Capacitor 24 preferably has a value of at least five thousand microfarads. Switching regulator 103 has an effective bandwidth of about one hundred kilohertz, and consequently maintains supply voltage $V_{REG}$ within the specified tolerance primarily when load current $I_{LOAD}$ changes at a low frequency.

When $I_{LOAD}$ has high frequency components, the resulting transient currents are supplied by transient generator 102, which has an effective bandwidth in excess of one megahertz. Transient generator 102 includes a transient controller 10, transistors 16–17, a transformer 26 and a resistor 32. Transient controller 10 includes a linear regulator that senses changes in $I_{LOAD}$ and provides drive signals for turning on transistors 16–17 to generate transient components $I_{TR1}$ and $I_{TR2}$. The linear regulator has a higher power dissipation than switching regulator 103. Components of transient controller 10 are formed on a semiconductor die for housing in an integrated circuit package. A reference input 18 is coupled to node 34 to establish a reference potential for biasing transistor 16 and a reference input 19 is operated at ground potential to establish a reference potential for biasing transistor 17. field effect transistors which typically have gate-source conduction thresholds of 2.5 volts and gate capacitances in excess of one nanofarad.

Transformer 26 comprises a 1:50 step up transformer having a primary winding 28 for routing load current $I_{LOAD}$ and a secondary winding 30 for providing a sense signal $V_{SENSE}$. When $I_{LOAD}$ is constant, sense signal $V_{SENSE}$ is essentially zero volts and when $I_{LOAD}$ changes, $V_{SENSE}$ has a nonzero value. Transformer 26 thereby operates as a sense element that detects changes in $I_{LOAD}$ and develops $V_{SENSE}$ across a resistor 32 to represent the changes. As an alternate embodiment, a sense element can comprise a resistor, a coil, a Hall effect device, or similar components having a conduction path for detecting a current change to develop a sense signal. Transformer 26 is configured so that an increase in $I_{LOAD}$ produces $V_{SENSE}$ with a positive polarity and a decrease produces $V_{SENSE}$ with a negative polarity.

A feature of the present invention is that changes in $I_{LOAD}$ are sensed directly through transformer 26 rather than indirectly by detecting output voltage changes as is done with prior art regulators. Current sensing is faster than voltage sensing because capacitor 24 slows down voltage changes but not current changes. For example, a step increase in $I_{LOAD}$ is detected almost immediately by transformer 26, while a corresponding change in $V_{REG}$ is delayed because of the linear rate of decay across capacitor 24. Moreover, current sensing is more reliable because it is less susceptible to noise on node 34, which can trigger spurious transients. In addition, current sensing allows a change in $I_{LOAD}$ to be detected independent of the value of supply voltage $V_{REG}$. Therefore, the present invention improves on previous regulators because transient generator 102 does not interfere with the voltage regulation loop of switching regulator 103.

When $V_{SENSE}$ is positive, transient controller 10 produces a first drive signal $V_{DRIVE1}$ at an output 13 that turns on transistor 16 to source transient current component $I_{TR1}$ into node 34 to increase $I_{LOAD}$. When $V_{SENSE}$ is negative, transient controller 10 produces a second drive signal $V_{DRIVE2}$ at an output 15 to turn on transistor 17, which sinks transient current component $I_{TR2}$ at node 34 to reduce $I_{LOAD}$. Such current sinking prevents energy stored in coil 22 from charging capacitor 24 to an excessive voltage during a current cycle of switching regulator 103.

For a step change in load current $I_{LOAD}$, sense signal $V_{SENSE}$ decays at a rate determined by a time constant L/R, where L is the effective inductance of secondary winding 30 and R is the resistance of resistor 32. In one embodiment, L=25.0 microhenries and R=0.83 ohms to produce a thirty microsecond time constant.

Figure 2:
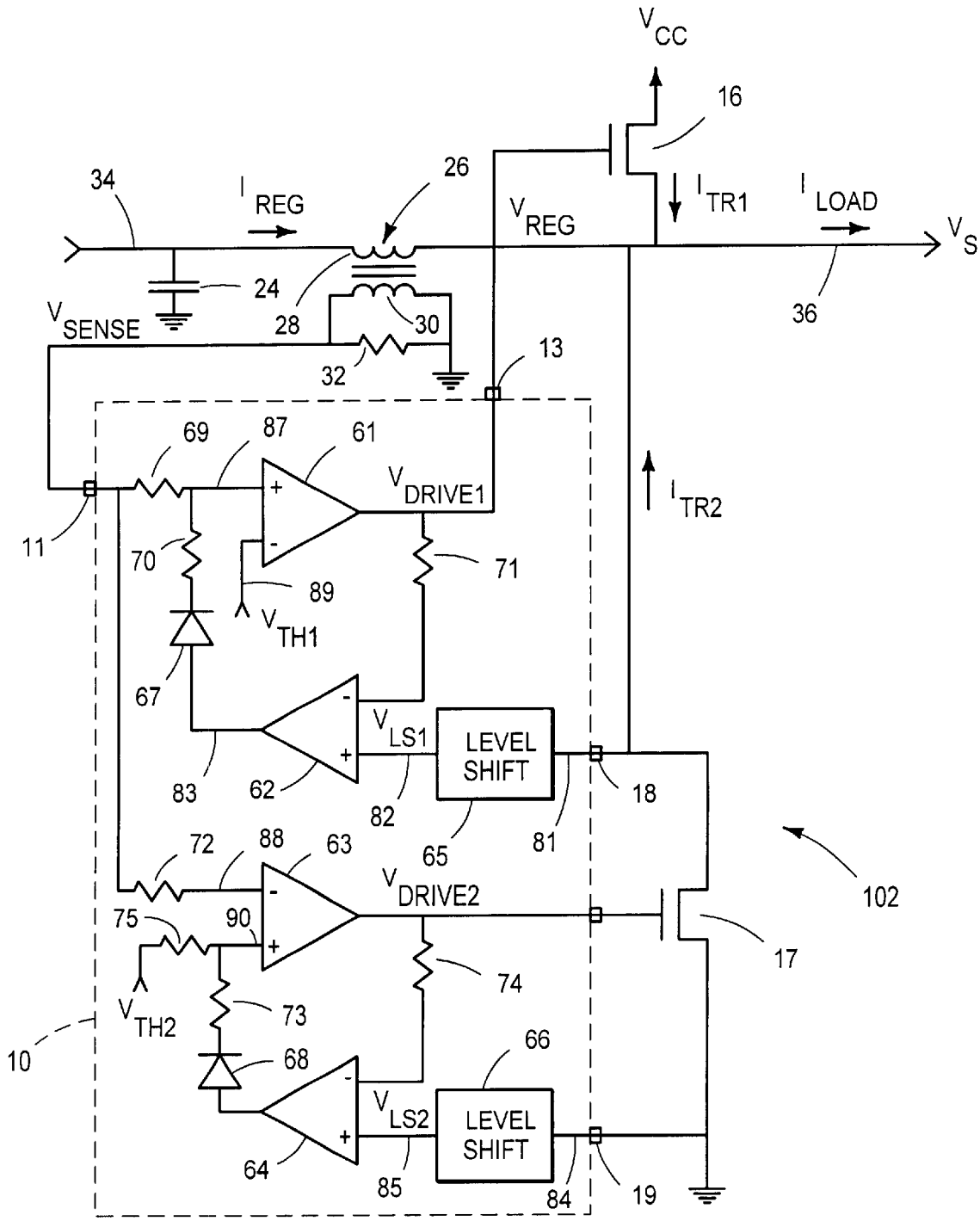
FIG. 2 is a schematic of a transient generator.

FIG. 2 is a schematic diagram showing transient generator 102 including transient controller 10 in further detail. Transient controller 10 includes amplifiers 61–64, level shifters 65–66, diodes 67–68 and resistors 69–75. Amplifiers 61–64 each have a gain of at least one hundred and a bandwidth of at least one megahertz. Level shifters 65–66 may include a voltage reference circuit, one or more diodes, a voltage divider or other components suitable for providing a one volt level shift. Resistors 69–75 are 3.3 kilohm resistors.

Under constant load conditions, i.e., when load current $I_{LOAD}$ is a DC current, sense signal $V_{SENSE}$ is zero and input 11 operates at ground potential. Amplifier 62 and level shifter 65 function as a level shifting circuit for biasing transistor 16 closer to conduction in order to reduce the swing of output 13. Level shifter 65 has an input 81 for receiving supply voltage $V_{REG}$=1.5 volts to establish a reference potential for biasing the source of transistor 16. Level shifter 65 level shifts $V_{REG}$ by one volt to produce a level shifted signal $V_{LS1}$=2.5 volts at an output 82.

The present invention features a first biasing feedback path formed by amplifier 62, diode 67, and resistor 70 for operating amplifier 61 at unity gain when load current $I_{LOAD}$ is not changing. Amplifier 61 amplifies level shifted signal $V_{LS1}$ to produce a quiescent component of drive signal $V_{DRIVE1}$=2.5 volts. Hence, the quiescent gate to source bias of transistor 16 is $V_{DRIVE1}-V_{REG}$=1.0 volts, which is less than the 2.5 volt conduction threshold. As a result, transistor 16 remains turned off while leaving sufficient noise margin to avoid noise inadvertently turning it on. In effect, level shifting reduces the gate voltage swing needed to turn on transistor 16. Because the gate of transistor 16 is highly capacitive, a reduced voltage swing reduces the slew time of amplifier 61 and the response time of transient generator 102. In addition, by maintaining $V_{DRIVE1}$ at the predetermined bias level of 2.5 volts, the first biasing feedback path prevents the output of amplifier 61 from saturating when no $I_{LOAD}$ transient is present, which further reduces the response time of transient generator 102 when a transient does occur. During a transient, diode 67 is reverse biased to isolate amplifier 62 from amplifier 61, thereby breaking the first biasing feedback path to operate amplifier at a higher gain.

In a similar fashion, amplifier 64 and level shifter 66 function as a one volt level shifting circuit for biasing transistor 17 closer to conduction. An input 84 of level shifter 66 is coupled to input 19 to establish a biasing reference at the source of transistor 17 at ground potential. Level shifter 66 level shifts one volt to produce a level shifted signal $V_{LS2}$=1.0 volts at an output 85. Amplifier 64, diode 68, and resistor 73 form a second biasing feedback path for operating amplifier 63 at unity gain. $V_{LS2}$ is amplified by amplifier 63 to produce a drive signal $V_{DRIVE2}$=1.0 volts at the gate of transistor 17. Hence, transistor 17 is turned off, but an increase of only 1.5 volts in $V_{DRIVE2}$ is needed to turn it on. Since transistor 17 has a high gate capacitance, level shifting allows amplifier 63 to turn on transistor 17 more rapidly, thereby reducing the response time of transient generator 102. By maintaining $V_{DRIVE2}$ at the predetermined bias level of 1.0 volts, the second biasing feedback path prevents the output of amplifier 63 from saturating when no $I_{LOAD}$ transient is present, which further reduces the response time of transient generator 102. During a transient, diode 68 is reverse biased to isolate amplifier 64 from amplifier 63, thereby breaking the second biasing feedback path to operate amplifier 63 at a higher gain.

A threshold signal $V_{TH1}$ is received at input 89 of amplifier 61 and a threshold signal $V_{TH2}$ is received through a resistor 75 at input 90 of amplifier 63. $V_{TH1}$ and $V_{TH2}$ establish minimum magnitudes of sense signal $V_{SENSE}$ to which transient generator 102 responds. In effect, $V_{TH1}$ and $V_{TH2}$ define the minimum change in $I_{LOAD}$ that results in transient generator 102 producing transient currents $I_{TR1}$ and/or $I_{TR2}$. In one embodiment, $V_{TH1}=V_{TH2}$=0.1 volts, which represents a change of six amperes in $I_{LOAD}$. Smaller transient currents are effectively supplied by switching regulator 103.

Figure 3:
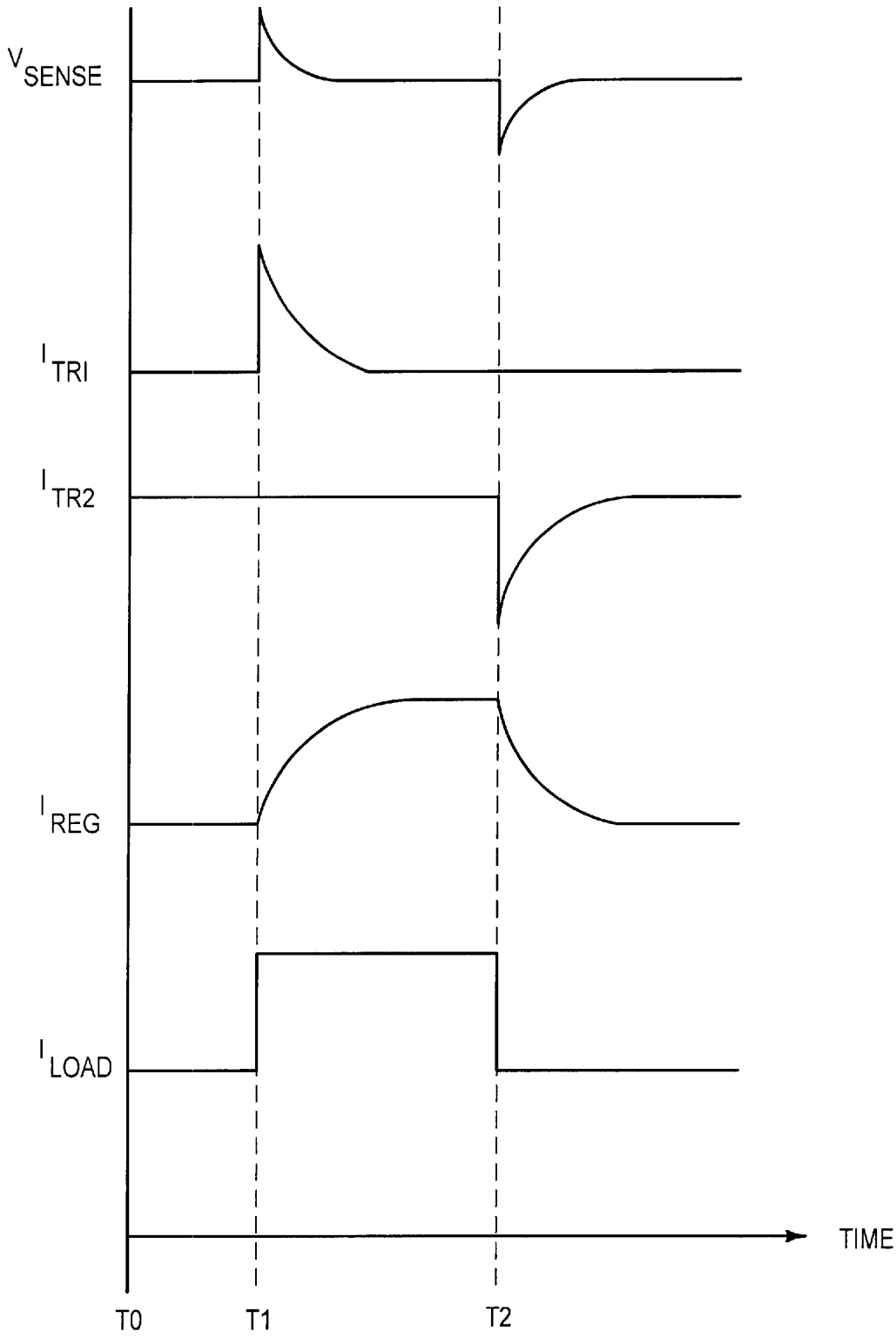
FIG. 3 is a timing diagram showing waveforms of the power supply.

The operation of transient generator 102 during a change in load current $I_{LOAD}$ can be seen by referring to the timing diagram of FIG. 3, showing waveforms $I_{LOAD}$, $V_{SENSE}$, $I_{REG}$, $I_{TR1}$ and $I_{TR2}$ of power supply 100. Initially, at time T0=0, we assume that microprocessor 50 draws a constant six ampere DC current so that $I_{LOAD}=I_{REG}$=6.0 amperes. Hence, $V_{SENSE}$=0.0 volts and $I_{TR1}=I_{TR2}$=0.0 amperes.

At time T1, load current $I_{LOAD}$ incurs a thirty ampere step function increase. The increase in $I_{LOAD}$ is sensed by primary winding 28 to induce sense signal $V_{SENSE}$ across secondary winding 30 and resistor 32 with a positive polarity and an amplitude of five hundred millivolts. The corresponding voltage drop across primary winding 28 is ten millivolts, which maintains supply voltage $V_S$ within the specified operating range and ensures that $V_{REG}$ and $V_S$ operate at substantially the same potential.

Sense signal $V_{SENSE}$ increases the potential at input 87 to reverse bias diode 67 and isolating amplifier 62 from amplifier 61 to effectively break the first biasing feedback path. Amplifier 61 amplifies and level shifts $V_{SENSE}$ to produce a positive transient component of drive signal $V_{DRIVE1}$. Transistor 16 turns on to supply transient current $I_{TR1}$ to node 34 to compensate for the step increase in $I_{LOAD}$.

Note that current $I_{REG}$ changes at a slower rate than the step change of $I_{LOAD}$ due to the lower bandwidth of switching regulator 103, as shown in the interval between T1 and T2. In comparison, sense signal $V_{SENSE}$ and transient component $I_{TR1}$ respond more rapidly to compensate for the step change in $I_{LOAD}$ and decay exponentially to allow switching regulator 103 to recover. $V_{SENSE}$ decays at a rate determined by the L/R time constant described above until transistor 16 turns off.

Because $V_{SENSE}$ has a positive polarity, diode 68 remains forward biased and the second biasing feedback path remains closed. Hence, the gate potential of transistor 17 remains at one volt and transistor 17 remains turned off.

At time T2, load current $I_{LOAD}$ incurs a thirty ampere step decrease, so $V_{SENSE}$ is produced with a negative polarity which decreases the potential at input 88 of amplifier 63. Output 15 increases in potential while output 86 of level shifter 64 decreases, reverse biasing diode 68 to isolate the second level shift circuit from amplifier 63 and break the second biasing feedback path. $V_{SENSE}$ is amplified by amplifier 63 to produce a positive transient component of drive signal $V_{DRIVE2}$, turning on transistor 17 to sink transient current $I_{TR2}$ to compensate for the step decrease in $I_{LOAD}$. Transient current $I_{TR2}$ prevents the charging current stored in coil 22 from raising $V_{REG}$ above the specified range during a cycle of switching regulator 103. Diode 67 remains forward biased, so the first biasing feedback path remains closed and transistor 16 remains turned off.

By now it should be appreciated that the present invention provides a regulator circuit and method of regulating a power supply signal. The load current of the regulator circuit is routed through a sense element which has an output for developing a sense signal representative of a change in the load current. An amplifier has an input for sensing the output signal and an output for producing a transient signal in response to a change in the output signal. A feedback path is coupled between the output and the first input of the amplifier to set the gain of the amplifier to a first value when the output signal is constant and to a second value different from the first value when the output signal changes. The feedback path has a level shift circuit that level shifts the output signal to set the output of the amplifier to a predetermined level. The current sensing and level shifting speed up the response of the regulator to changes in the load current, thereby maintaining the power supply voltage at a substantially constant potential during a load current transient.

What is claimed is:

1. A regulator, comprising:

a first amplifier having a first input coupled for sensing an output signal of the regulator and an output for producing a transient signal in response to a change in the output signal; and a first feedback path coupled between the output and the first input of the first amplifier to set a gain of the first amplifier to a first value when the output signal is constant and to a second value when the output signal changes.

2. The regulator of claim 1, wherein the first feedback path includes a first level shift circuit having a first input coupled for receiving the output signal and an output coupled to the first input of the first amplifier for biasing the output of the first amplifier to a predetermined level.

3. The regulator of claim 2, wherein the first level shift circuit has a second input coupled to the output of the first amplifier.

4. The regulator of claim 2, wherein the first level shift circuit includes:

a level shifter having an input coupled to the first input of the first level shift circuit; and a second amplifier having a first input coupled to an output of the level shifter, a second input coupled to the output of the first amplifier, and an output coupled to a second input of the first amplifier.

5. The regulator of claim 1, wherein the change in the output signal produces a sense signal at the first input of the first amplifier, and the first feedback path includes a first diode coupled for isolating the output of the first amplifier from the second input of the first amplifier when the sense signal has a first polarity.

6. The regulator of claim 5, further comprising:

a second level shift circuit having a first input for receiving a reference signal and an output for level shifting the reference signal; and a second amplifier having a first input coupled to the output of the second level shift circuit, a second input coupled for receiving the sense signal, and an output for providing the transient signal when the sense signal has a second polarity.

7. The regulator of claim 6, further comprising a second diode coupled for isolating the second level shift circuit from the second amplifier when the sense signal has the second polarity.

8. The regulator of claim 5, wherein the first amplifier is biased with a threshold signal, and the transient signal is generated when the sense signal is greater than the threshold signal.

9. The regulator of claim 5, wherein the sense signal is produced by a change in a current flow of the output signal and the transient signal includes a current that is greater than twenty amperes.

10. The regulator of claim 1, wherein the output signal of the regulator operates at less than two volts.

11. The regulator of claim 1, further comprising an integrated circuit package for housing the first amplifier and first feedback path.

12. An integrated regulator circuit, comprising:

a level shift circuit having a first input for coupling to a node to establish a reference potential and an output for level shifting the reference potential; and an amplifier having a first input coupled to the output of the level shift circuit, a second input for receiving a sense signal indicative of a current flow at the node, and an output for providing a transient current to the node when the current flow changes.

13. The integrated regulator circuit of claim 12, wherein the level shift circuit includes:

a level shifter having an input coupled to the input of the level shift circuit; and a feedback amplifier having a first input coupled to an output of the level shifter, a second input coupled to the output of the amplifier, and an output coupled to the first input of the amplifier.

14. A regulator circuit, comprising:

a sense element having a conduction path for routing a current and an output for developing a sense signal indicative of a change in the current; and an amplifier having an input coupled for receiving the sense signal and an output for generating a transient current to compensate for the change in the current.

15. The regulator circuit of claim 14, wherein the sense element comprises a coil for routing the current.

16. The regulator circuit of claim 14, wherein the sense element includes a transformer having a first winding for routing the current and a second winding for developing the sense signal.

17. The regulator circuit of claim 16, wherein the sense element includes a resistor coupled to the second winding to establish a time constant of the transient current.

18. A method of regulating, comprising the step of:

sensing a change in a current flowing at a node to produce a sense signal; and amplifying the sense signal to generate a transient current at the node to compensate for the change.

19. The method of claim 18, further comprising the step of level shifting the sense signal to reduce a response time of the transient current.

20. The method of claim 18, wherein the step of sensing includes the step of routing the current through a conduction path.

21. A method of regulating a power supply signal, comprising the step of:

level shifting the power supply signal to produce a level shifted signal; and amplifying the level shifted signal to generate a transient signal that compensates for a change in the power supply signal.

22. The method of claim 21, further comprising the steps of:

detecting the change in the power supply signal to produce a sense signal; and amplifying the sense signal to produce the transient signal.

23. The method of claim 22, wherein the step of detecting includes the steps of:

routing a current of the power supply signal through a conduction path; and generating the sense signal when the current changes.

24. A method of regulating a signal, comprising the steps of:

amplifying a transient component of the signal with a first gain to produce a transient signal that compensates for the transient component; and amplifying a quiescent component of the signal with a second gain to establish a bias level of the transient signal.

25. The method of claim 24, further comprising the step of sensing a change in the signal to produce the transient component of the signal.

26. The method of claim 24, wherein the step of amplifying the quiescent component includes the step of level shifting the quiescent component to establish the bias level.

* * * * *